US005415016A

United States Patent [19]

Hirai et al.

[11] Patent Number: 5,415,016

[45] Date of Patent: May 16, 1995

[54] KNITTED FABRIC PRESSER UNIT OF FLAT KNITTING MACHINE

[75] Inventors: Ikuhito Hirai; Toshinori Nakamori, both of Wakayama, Japan

[73] Assignee: Shima Seiki Manufacturing Limited, Wakayama, Japan

[21] Appl. No.: 149,567

[22] Filed: Nov. 9, 1993

[30] Foreign Application Priority Data

Nov. 9, 1992 [JP] Japan ..... 4-298770

[51] Int. Cl.[6] ..... D04B 7/04

[52] U.S. Cl. ..... 66/109; 66/64; 66/90

[58] Field of Search ..... 66/64, 90, 60 R, 147, 66/95, 96 R, 104, 107, 108 R, 108 A, 109, 110

[56] References Cited

U.S. PATENT DOCUMENTS

| | | | |
|---|---|---|---|
| 3,007,324 | 11/1961 | Bräm | 66/64 |
| 3,685,317 | 8/1972 | Giachetti et al. | 66/64 |
| 4,442,683 | 4/1984 | Shima et al. | 66/64 |
| 4,852,369 | 8/1989 | Stoppazzini | 66/64 |
| 5,060,488 | 10/1991 | Stoppazzini | 66/64 |
| 5,063,755 | 11/1991 | Shima et al. | 66/64 |

FOREIGN PATENT DOCUMENTS

| | | |
|---|---|---|
| 0401176 | 12/1990 | European Pat. Off. . |
| 2647817 | 12/1990 | France . |
| 3710396 | 1/1988 | Germany . |
| 58-46156 | 3/1983 | Japan . |
| 62-15662 | 4/1987 | Japan . |
| 3-66415 | 10/1991 | Japan . |
| 2097431 | 11/1982 | United Kingdom . |

*Primary Examiner*—Clifford D. Crowder
*Assistant Examiner*—Larry D. Worrell, Jr.
*Attorney, Agent, or Firm*—Wenderoth, Lind & Ponack

[57] ABSTRACT

A knitted fabric presser unit includes pressers corresponding to respective reciprocal directions and installed in a carriage. A first presser presses a knitted fabric when the carriage is being moved in a first knitting direction, during which a second presser is in a rest position. The first presser moves in conjunction with displacement in one direction of a sliding plate due to a follower engaged with a grooved cam. Similarly, the second presser moves in conjunction with displacement in another direction of the sliding plate due to a follower engaged with a grooved cam. Displacement of the sliding plate is caused by a rack engaged with a pinion fixed at a rotation axis of a motor. Movement traces of the first presser and the second presser are determined so that the two pressers are prevented from interfering with each other on movement thereof between a respective pressing and rest positions.

28 Claims, 16 Drawing Sheets

KNITTED FABRIC PRESSER UNIT OF FLAT KNITTING MACHINE

BACKGROUND OF THE INVENTION

1. Field of the Invention

The present invention relates to a knitted fabric presser of a flat knitting machine, particularly to such a presser which is installed at a carriage unit to be movable between a pressing position where the presser is operative and a resting position where the presser is inoperative.

2. Description of the Related Art

Conventionally, a knitted fabric presser as shown in FIG. 20 is used at each lock of a carriage unit in a flat knitting machine, especially, V-bed type flat knitting machine. The knitted fabric presser is also called a stitch presser. A horizontal portion of an L-shaped presser 101 presses a knitted fabric 102 from above. In a flat knitting machine of the V-bed type, a front needle bed 103 and a rear needle bed 104 are arranged opposite to each other in a reversed V arrangement. Press functioning of the presser 101 is conducted at a gap 105 formed between the front needle bed 103 and the rear needle bed 104. When knitting needles 106, 107 ascend for knitting or transferring, by pressing the knitted fabric 102 inside the gap 105, uppermost loops 108, 109 of the knitted fabric 102 are prevented from moving. When pressing is not necessary, the presser 101 is moved from the gap 105 without touching sinkers 110, 111.

The presser 101, which is generally L-shaped, presses the knitted fabric 102 by a horizontal portion thereof extending along a direction of movement of a carriage. A portion of the presser 101 transverse to the direction of movement of the carriage is attached to a mechanism which makes the presser 101 move in conjunction with the carriage. A yarn for knitting the fabric 102 is fed to points of the knitting needles 106, 107 almost in the middle of the horizontal portion of the presser 101. The vertical portion of the presser 101 must be placed upstream of a knitting direction in order to space the presser 101 from the loops 108, 109 formed by knitting action of the knitting needles 106, 107. Therefore, both forward and backward movements of presser 101 are necessary in order to reciprocally knit in relation to longitudinal directions of the needle beds 103,104. A sufficient length of the horizontal portion of the presser 101 is required in order to satisfactorily press the knitted fabric 102. Though it is possible to turn the direction of the horizontal portion on the assumption that the vertical portion is a rotation axis, that requires an impractically large space. It is a practical arrangement that pressers 101 for respective forward and backward movements are provided, and a particular presser 101 is actuated according to a particular movement direction.

There are generally two ways to install a stitch presser as shown in FIG. 20. One way is to install the stitch presser on an upper portion of a cam box of the carriage crossing over the front and rear needle beds. The other way is to install the stitch presser on a yarn guide rail provided just above a gap along a longitudinal direction of the needle bed.

A prior art arrangement of the type to install the presser on the upper portion of a cam box is disclosed, for example, in Japanese Examined Patent Publication JP(B2) 62-15662 and JP(B2) 3-66415. According to the arrangement disclosed in JP(B2) 62-15662, a presser for forward movement is installed on an upper portion of one cam box, and a presser for backward movement is installed on another cam box. At the upper parts of both pressers are provided pins which are engaged with grooved cams. When a grooved cam reaches a receiving piece fixed on a respective longitudinal end of the needle bed, the respective presser is switched to be operative or inoperative. Further, according to the prior art arrangement disclosed in JP(B2) 3-66415, function or non-function of the presser is switched by using a stepping motor and a swing arm.

A prior art arrangement with a stitch presser installed on a yarn guide rail is disclosed, for example, in Japanese Unexamined Patent Publication JPA 58-46156. According to such arrangement, the stitch presser, moving together with a carriage, is installed on the yarn guide rail just above a gap, and the direction of movement of the presser is changed by receiving pieces provided at opposite ends of a needle bed. Though a large number of yarn feeders are required to run in a flat knitting machine, employing such type of stitch presser installed on a yarn guide rail causes a decrease of the number of yarn feeders capable of running.

In the prior art arrangement disclosed in JP(B2) 62-15662 and JP(B2) 3-66415, the number of yarn feeders running on a yarn guide rail does not decrease because a stitch presser is installed on a carriage, which is different from the prior art arrangement disclosed in JP(B2) 58-46156. According to the arrangement disclosed in JP(B2) 62-15662 and JPA 58-46156, the direction of the presser cannot be changed unless a carriage reaches either of the longitudinal ends of the needle bed. In the arrangement disclosed in JP(B2) 3-66415, since function or non-function of a presser is switched by drive of a stepping motor, it is possible to conduct switching at any position regarding the longitudinal direction of the needle bed.

In certain cases of a flat knitting machine, it is unnecessary to use the entire longitudinal width of the needle bed for knitting. In such cases, if a presser does not need to be switched, it is possible to knit quickly by reciprocally moving a carriage only in a region where a knitted fabric is formed. If it is necessary to move the carriage to a longitudinal end of the needle bed in order to switch a presser, knitting time cannot be reduced no matter how narrow may be the width of the knitted fabric.

According to the arrangement disclosed in JP(B2) 3-66415, function or non-function of a presser can be switched at any longitudinal position of the needle bed by a unit including a stepping motor and a swing arm. That, however, requires a large size carriage or limits positions of installation because respective units are needed for forward and backward movements. On the other hand, according to the arrangement disclosed in JP(B2) 62-15662 and JP(B2) 3-66415, respective pressers for forward and backward movements should be arranged separately on carriages for front and rear needle beds. This is because the respective pressers interfere with each other if they are arranged on the same carriage. More specifically, it is easy to prevent the pressers from interfering with each other when one presser is placed in a pressing position and the other presser is placed in a rest position. However, when both pressers are in rest positions or when the positions thereof are on route to be mutually changed, there is a high likelihood that they will interfere with each other because of overlapping of movement traces or paths of movement thereof. In case the horizontal portion of the presser is decreased in length, the probability of interference can be reduced. However, a knitted fabric cannot be pressed satisfactorily by a presser with a horizontal portion of short length.

SUMMARY OF THE INVENTION

It is an object of the invention to provide a knitted fabric presser for a V-bed type flat knitting machine, which is installed as one unit at a carriage of a needle beds and which is able to be switched easily for opposite reciprocal directions of movement of the carriage.

The invention provides a knitted fabric presser unit of a flat knitting machine, installed at a carriage of the flat knitting machine, for pressing a fabric knitted in accordance with movement of the carriage, and comprising:

a first presser for pressing the knitted fabric on movement of the carriage in one of opposite longitudinal directions of a needle bed;

a second presser for pressing the knitted fabric on movement of the carriage in the other of the longitudinal directions of the needle bed;

a grooved cam plate being capable of reciprocal movement relative to the carriage and being provided with a first grooved cam for driving in one direction of the reciprocal movement and with a second grooved cam for driving in the other direction of the reciprocal movement;

means for driving the grooved cam plate relative to the carriage;

first back and forth movement means, having a follower engaged with the first grooved cam, for guiding the first presser from a pressing position to a first rest position where the knitted fabric is not pressed in conjunction with displacement of the follower on movement of the grooved cam plate in the one direction relative to the carriage, and for guiding the first presser from the first rest position to the pressing position in conjunction with displacement of the follower on movement of the grooved cam plate in the other direction relative to the carriage;

second back and forth movement means, having a follower engaged with the second grooved cam, for guiding the second presser from a second rest position, which is different from the first rest position, to a pressing position in conjunction with displacement of the follower on movement of the grooved cam plate in the one direction relative to the carriage, and for guiding the second presser from the pressing position to the second rest position in conjunction with displacement of the follower on movement of the grooved cam plate in the other direction relative to the carriage; wherein, movement traces of the first and second pressers are determined by the first and the second back and forth movement means so that interference of the first and second pressers with one another during movement thereof is prevented.

Furthermore, the grooved cam plate of the invention is characterized in that a grooved cam is formed thereon in order to control a position of a brush functioning to open a latch of a latch needle and the grooved cam plate. The knitted fabric presser unit further comprises means, which has a follower engaged with the grooved cam, for drawing back the brush from a functioning position thereof when either the first presser or the second presser is in the proximity of a pressing gap.

Furthermore, the first and the second back and forth movement means of the invention have first and second linking mechanisms for moving the first and second pressers respectively, and a portion of each linking mechanism is driven to move in accordance with displacement of each respective follower.

Furthermore, the present invention is characterized in that the driving grooved cams are formed in respective upper and lower stages. The first and the second back and forth movement means have first and second linking mechanism for moving the first and second pressers respectively. Two portions of each linking mechanism are connected with followers engaged respectively with the upper and lower stages of the grooved cams and are driven to move in accordance with displacement of each follower.

According to the invention, the first and second pressers are installed at the same carriage, because the pressers respectively press a knitted fabric on movement of the carriage in one direction and in the other direction. Each presser is actuated by reciprocating motion of a grooved cam plate relative to the carriage. In the grooved cam plate are formed a grooved cam for driving one of the pressers in the other direction. The first and second pressers each are moved reciprocally between a pressing position inside a gap and a respective rest position outside the gap by first and second back and forth movement means each having a following engaged with a respective grooved cam. Since a first rest position for the first presser is different from a second rest position for the second presser, and movement traces are determined so as to avoid interference with each other. The pressing position of each presser is allowed to over-lap with the other presser. Therefore, a construction capable of bi-directional switching is possible with only one unit.

Further according to the invention, a grooved cam is formed on the grooved cam plate for controlling a position of a brush which functions to open a latch of a latch needle. The brush is drawn back from a functioning position thereof when either the first or second presser moves near the gap. Since the brush does not contact with the presser on movement of the presser, the brush can be prevented from wearing, and the presser can be smoothly moved. Since timing of drawing back movement of the brush is controlled by the grooved cam, flexibility of synchronizing movement of the brush with movement of the presser can be enhanced.

Furthermore according to the invention, each of the first and the second back and forth movements means has a linking mechanism, and one portion of each linking mechanism is driven to move in conjunction with displacement of a follower engaged with a grooved cam. Therefore, it is easy to provide movement traces of the pressers to be prevented from interfering with each other, for example, by varying the length of each member forming the linking mechanism. Furthermore according to the invention, the grooved cams each are formed in upper and lower stages. Two pieces of the linking mechanisms for moving the first and the second pressers are respectively displaced in association with a follower which is displaced by engaging with each upper and lower groove stage. This moves the presser between a pressing position inside the gap and a rest position outside the gap. The first and second pressers can be prevented from interfering with each other by changing a phase of the grooved cams formed in double form or by changing the ratio of members forming the linking mechanism.

As described above, according to the invention it is possible to easily switch pressers to be used in accordance with a direction of movement of a single carriage moved reciprocally in opposite longitudinal directions of a needle bed, with each presser used for a respective direction. In addition, it is also possible to press on a corresponding needle bed side only, for example, by providing respective front and rear carriages of V-bed type flat knitting machine with respective pressers for forward and backward movements. For example, when only a needle bed on one side is used for knitting, although it is impossible to satisfactorily press a stitch only by pressing just under the gap because no loop is formed between the front and rear needle beds, satisfactory pressing of stitches is made possible by shifting a pressing position to the side of the used needle bed. Furthermore, satisfactory pressing of stitches can be realized by providing carriages for front and rear needle beds with respective pressers for forward and rearward movements, even if double plain stitch fabrics are knitted to form a cylindrical fabric by independently using each of the front and rear needle beds.

Furthermore according to the invention, it is easy to determine a proper timing for preventing a brush from wearing because, when either the first or second presser is moved near the pressing position, the brush can be drawn back from a functioning position thereof by providing a grooved cam plate with a grooved cam for controlling the position of the brush.

Furthermore according to the invention, it is easy to determine the movement traces of the first and second pressers to be moved to not interfere with each other, for example, by changing the ratio of members forming a linking mechanism, because a piece of each linking mechanism is displaced by respective driving groove cams.

Furthermore according to the invention, it is easy to determining the movement traces of the first and second pressers to be moved to not interfere with each other by changing the phase of the grooved cams in two steps or changing the ratio of the members of the linking mechanism, because the grooved cams for driving the first and second pressers are formed in two upper and lower stages, respectively, and respective two portions of the first and second linking mechanisms for each of the first and second pressers are displaced in conjunction with the two stages of the respective grooved cams.

BRIEF DESCRIPTION OF THE DRAWINGS

Other and further objects, features, and advantages of the invention will be made more explicit from the following detailed description taken with reference to the drawings wherein.

DETAILED DESCRIPTION OF THE INVENTION

Figure 1:
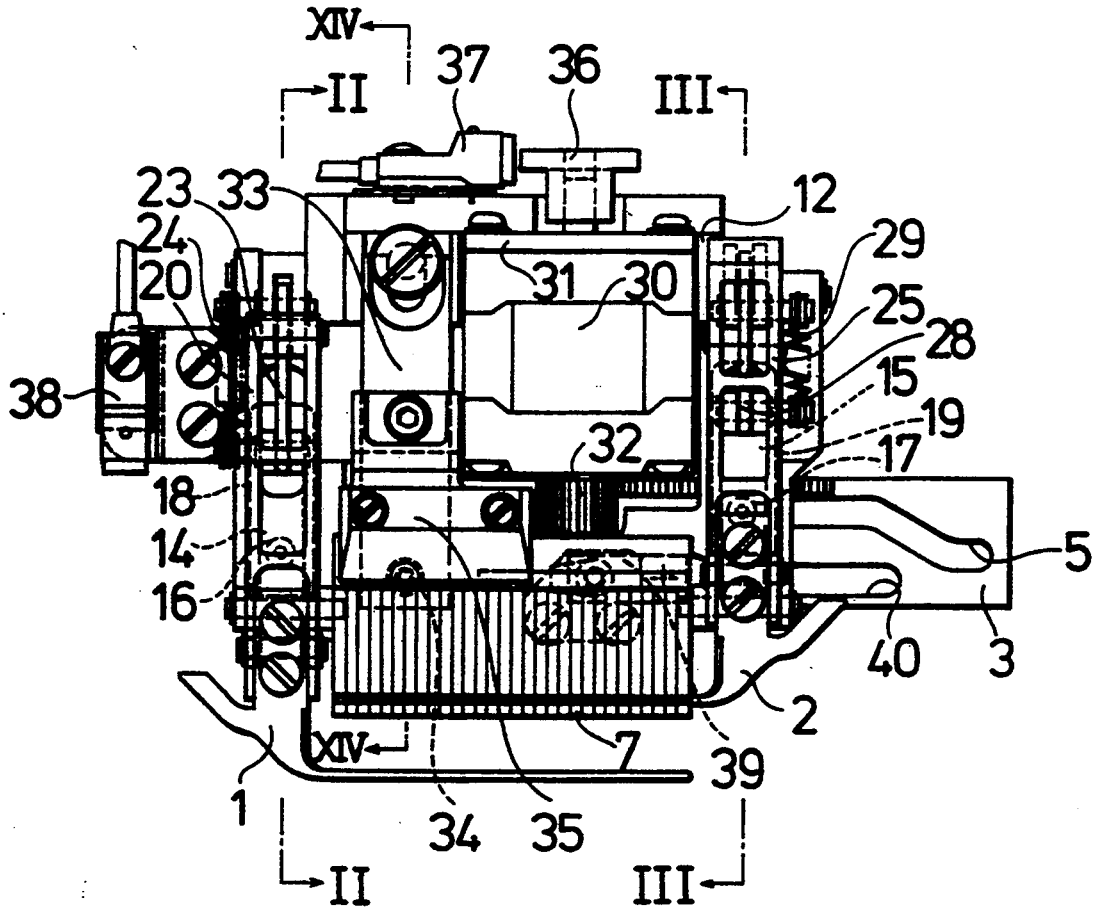
FIG. 1 is an elevational view which illustrates an embodiment of the invention.

Now referring to the drawings, preferred embodiments of the invention are described below.

Figure 2:
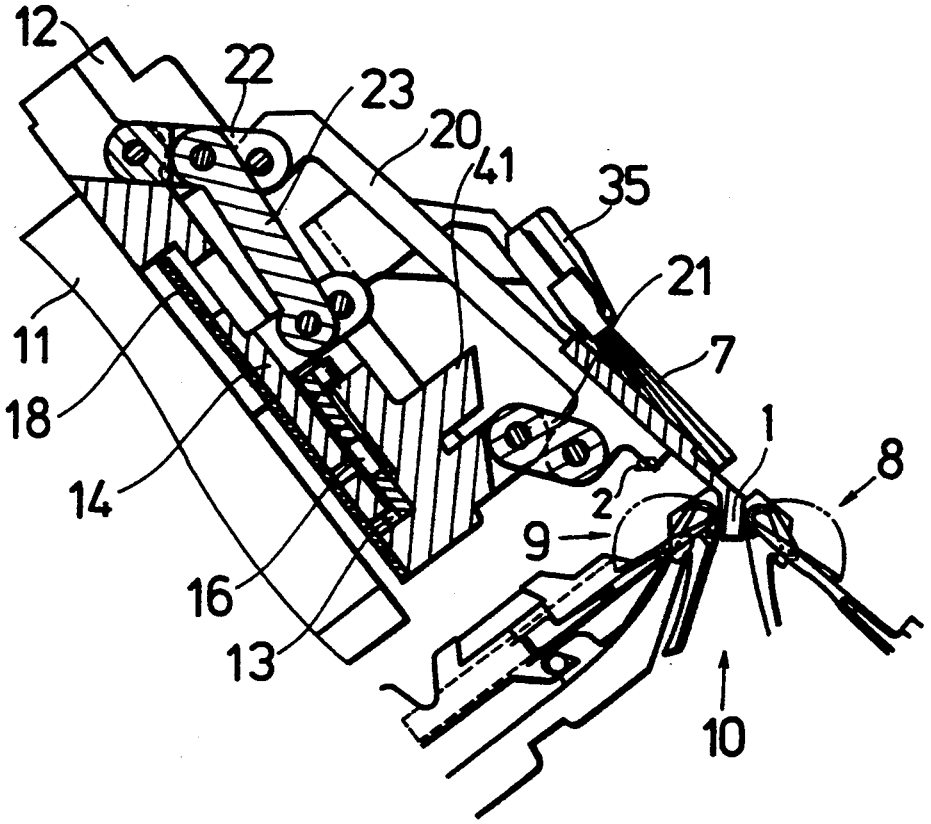
FIG. 2 is a sectional view taken along line II—II of FIG. 1.
Figure 3:
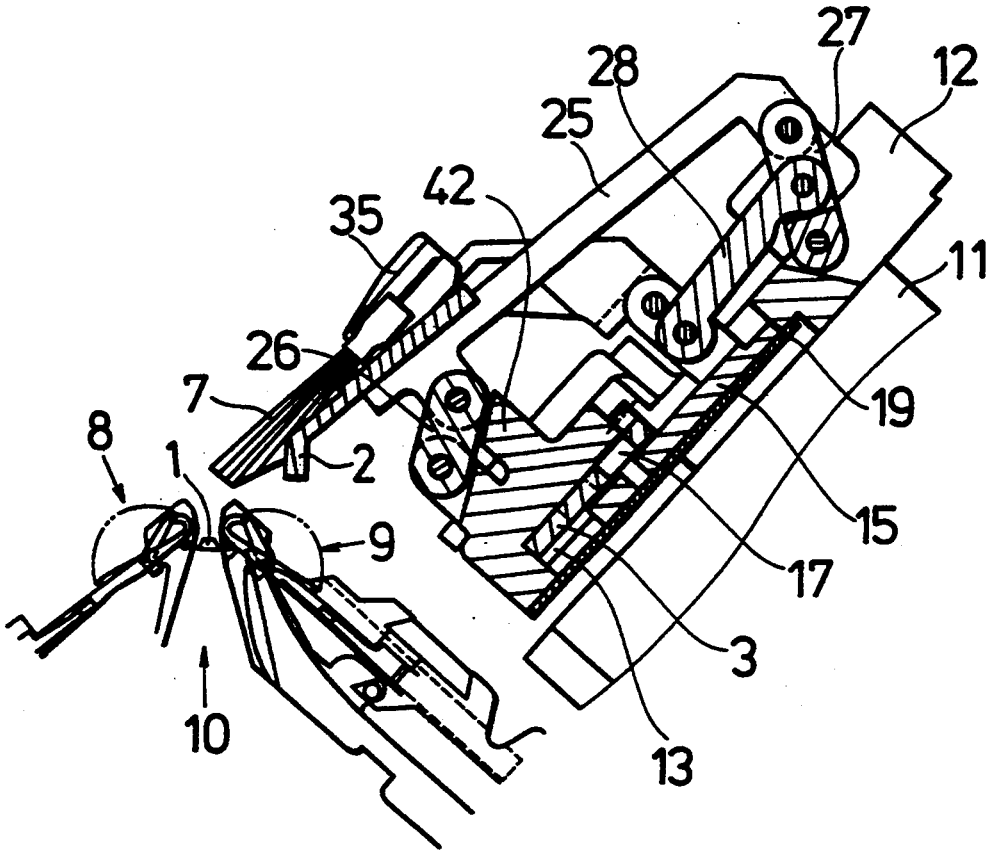
FIG. 3 is a sectional view taken along line III—III of FIG. 1.
Figure 4:
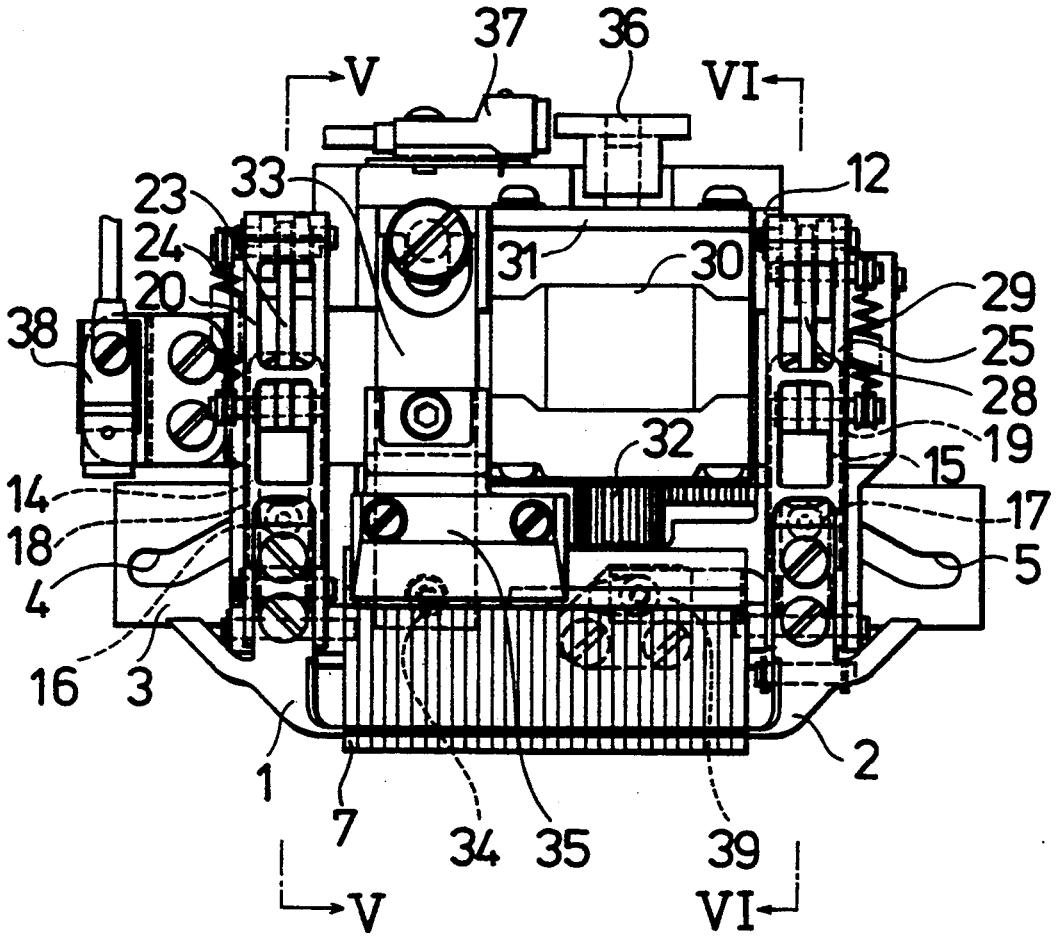
FIG. 4 is an elevational view which illustrates another working state of the embodiment shown in FIG. 1.
Figure 5:
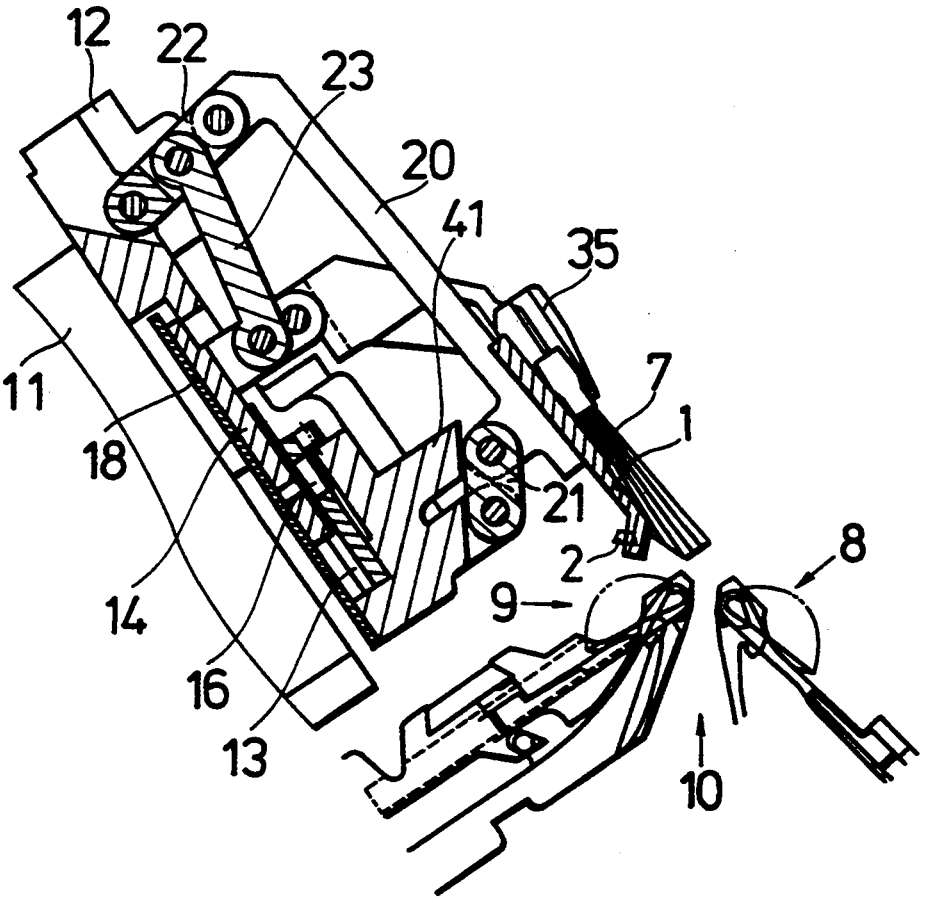
FIG. 5 is a sectional view taken along line V—V of FIG. 4.
Figure 6:
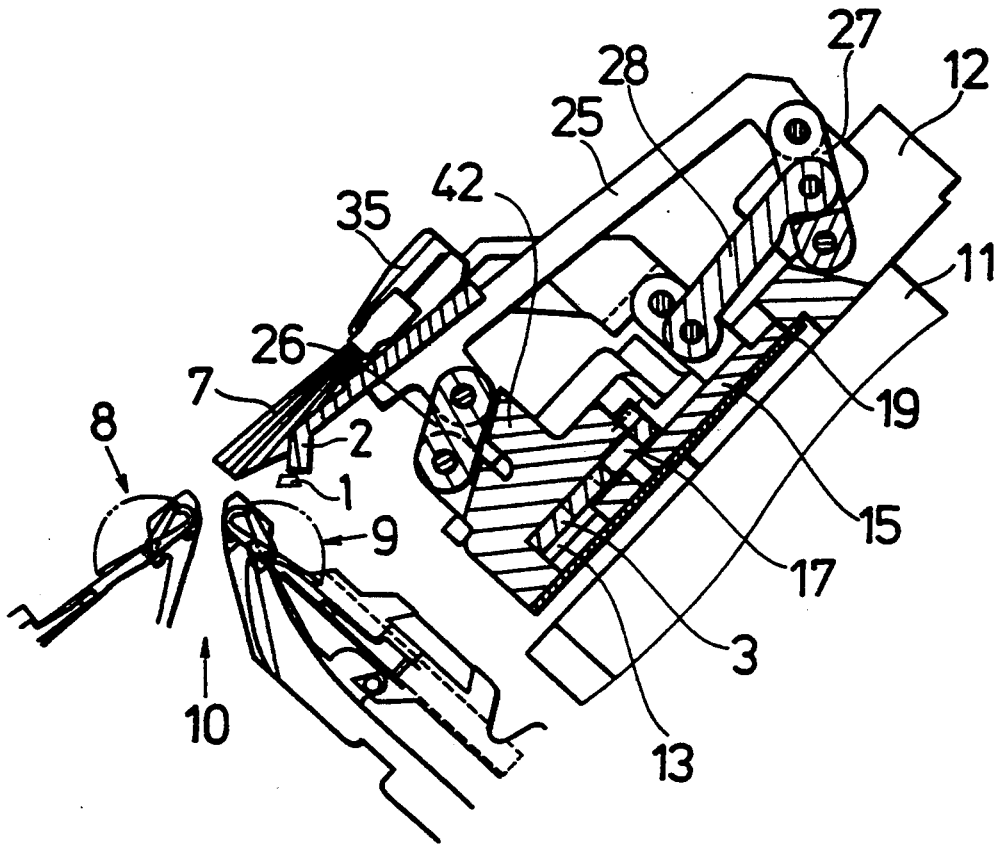
FIG. 6 is a sectional view taken along line VI—VI of FIG. 4.
Figure 7:
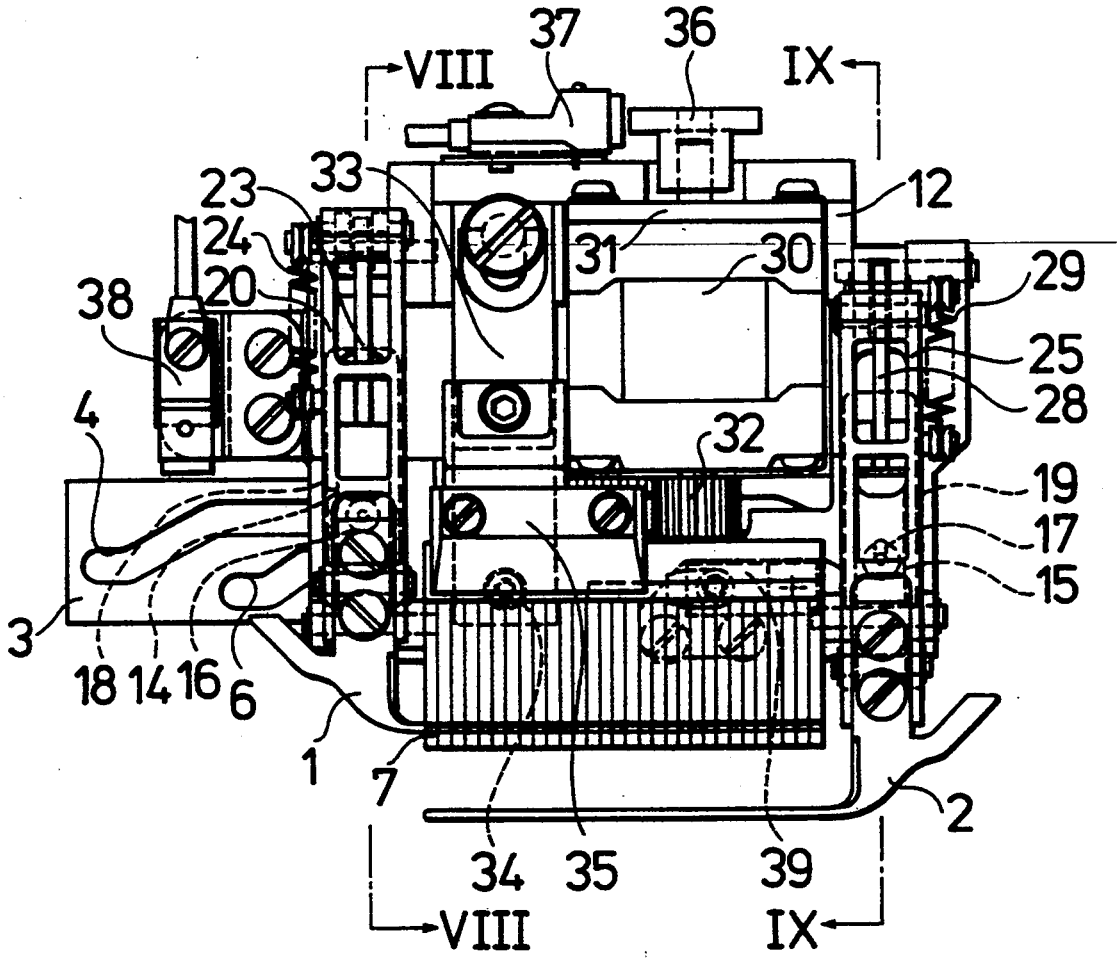
FIG. 7 is an elevational view which illustrates a further working state of the embodiment shown in FIG. 1.
Figure 8:
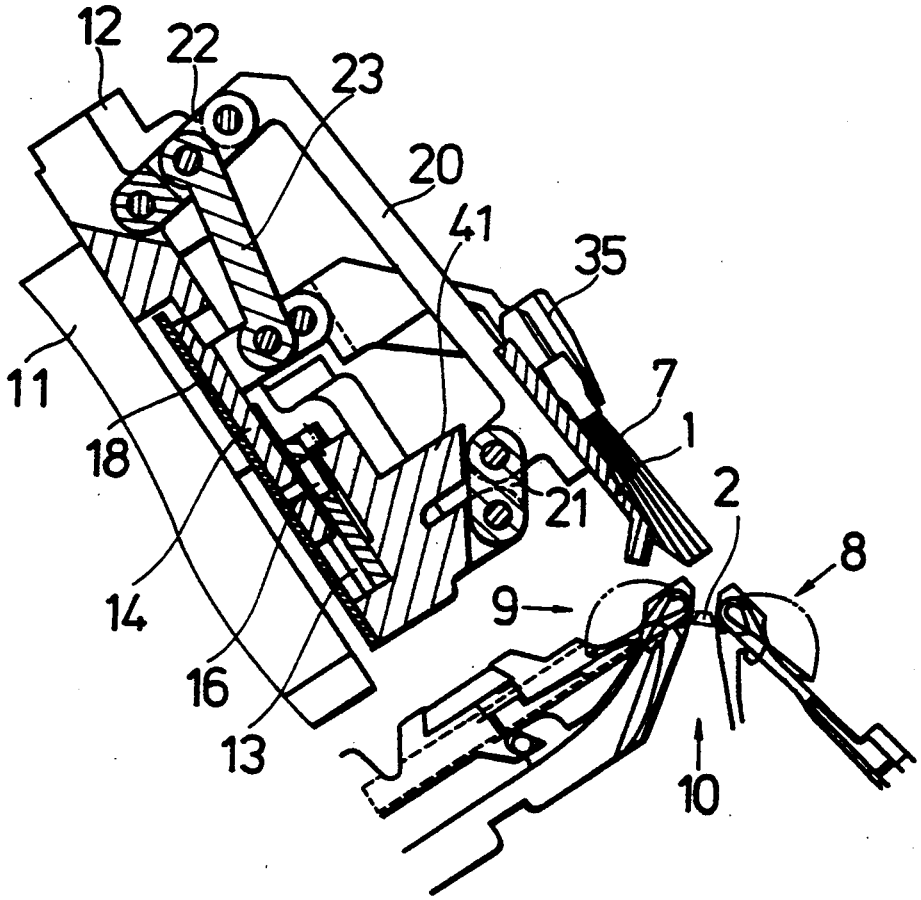
FIG. 8 is a sectional view taken along line VIII—VIII of FIG. 7.
Figure 9:
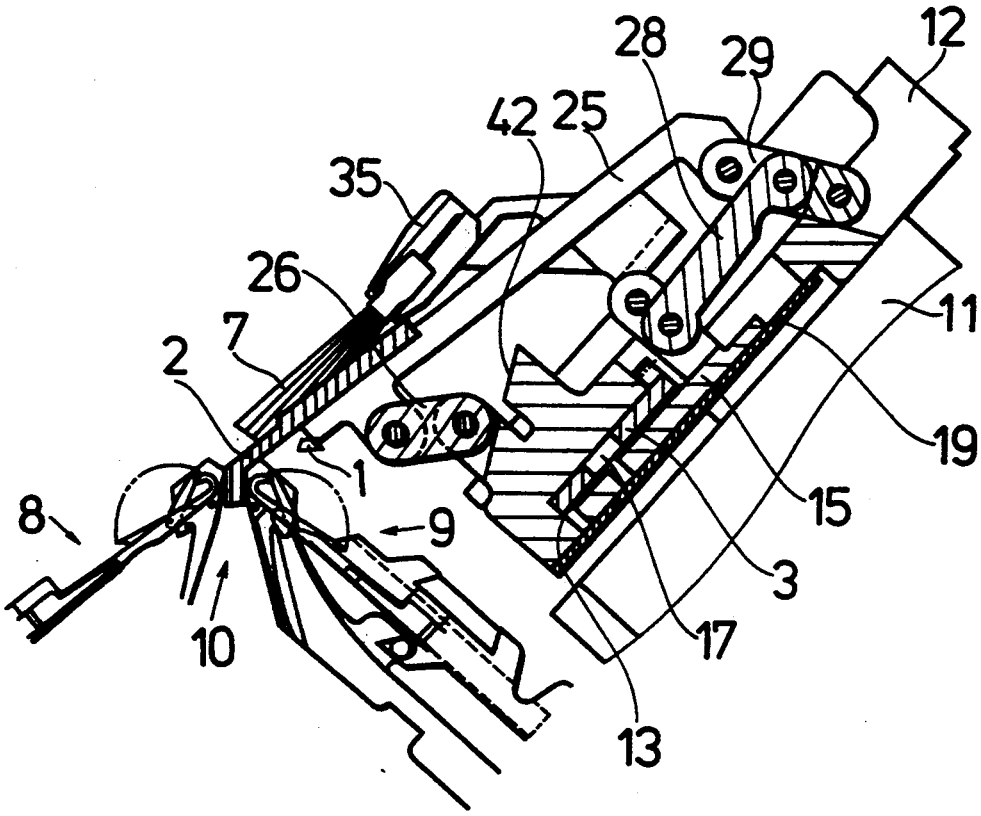
FIG. 9 is a sectional view taken along line IX—IX of FIG. 7.

FIGS. 1 to 14 show constitutions and operating states of an embodiment of the invention. FIGS. 1 to 3 show a pressing position of a first presser 1. FIGS. 4 to 6 show rest positions of first and second pressers, and FIG. 7 to 9 show a pressing position of the second presser 2. FIGS. 1, 4 and 7 are elevational views. FIGS. 2 and 3 are sectional views taken along line II—II and III—III of FIG. 1, respectively. FIGS. 5 and 6 are sectional views taken along lines V—V and VI—VI of FIG. 4, respectively. FIGS. 8 and 9 are sectional views taken along lines VIII—VIII and IX—IX of FIG. 7, respectively. Needle beds are not illustrated in FIGS. 1, 4 and 7. Parts of the pressers apart from the respective planes illustrated only as end faces in FIGS. 2, 3, 5, 6, 8 and 9.

The first presser 1 is used for pressing a knitted fabric when a carriage is moved to the left of FIGS. 1, 4 and 7 for knitting. The second presser 2 is used when the carriage is moved to the right. The actuation of the first and second pressers 1, 2 is switched by cam grooves or grooved cams 4, 5 formed in a grooved cam plate 3. A cam groove or grooved cam 6 for driving a brush 7 is also formed in the grooved cam plate 3, by which the brush 7 can be drawn back in order to be prevented from wearing when the first and second pressers 1, 2 are moving. The pressing action by the first and second pressers 1, 2 is performed inside a gap 10 between a front needle bed 8 and a rear needle bed 9.

A knitted fabric pressing unit including pressers 1, 2 is arranged on an upper end of a carriage 11 moving along rear needle bed 9. A bracket 12 is attached on an end face of the carriage 11. The bracket 12 mechanically supports various parts of the knitted fabric pressing unit.

The grooved cam plate 3 is inserted to the carriage 11 side of the bracket 12 so as to be slidable in a longitudinal direction of the needle bed 9. The grooved cam plate 3 is supported by a plate 13. When the grooved cam plate 3 slides in respective longitudinal directions of the needle bed, sliding plates 14, 15 are shifted in respective directions transverse to the longitudinal directions by the grooved cams 4, 5 in conjunction with displacement of followers 16, 17. The sliding plates 14, 15 are supported by plates 18, 19, respectively.

The displacement of the sliding plate 14 for driving in one direction is transmitted to a first linking mechanism composed of a first support arm 20, a first front arm 21, a first rear arm 22 and a first slide arm 23. The sliding plate 14 and the first linking mechanism form a first back and forth movement structure or assembly. The follower 16 is displaced in a direction transverse to the longitudinal direction of the needle bed by sliding of the grooved cam plate 3 in a longitudinal direction of the needle bed. The sliding plate 14 is slidably displaced in conjunction with the displacement of the follower 16 and causes the displacement of the first rear arm 22 via the first drive arm 23. Each of the first front arm 21 and the first rear arm 22 is axially supported at one end thereof with the bracket 12 and at the other end thereof with the support arm 20. When the first rear arm 22 is displaced by the drive arm 23, the first support arm 20 is displaced because the support of rear arm 22 on the bracket 12 is fixed. A first spring 24 is provided for the purpose of supplying pressure for the first presser 1 when pressing stitches. In a similar manner, the displacement of the sliding plate 15 for driving in the other direction is transmitted to a second linking mechanism composed of a second support arm 25, a second front arm 26, a second rear arm 27 and a second drive arm 28. The sliding plate 15 and the second linking mechanism form a second back and forth movement structure or assembly. A second spring 29 provides pressure when the second presser 2 is in the pressing position.

Relative movement of the grooved cam plate 3 is achieved by a drive in the form of motor 30. The motor 30 is fixed to the bracket 12 via a mounting plate 31. A rotation axis or output of the motor 30 is extended vertically downward in a direction transverse to the longitudinal direction of the needle bed, and a pinion 32 is fixed to such axis for displacing the grooved cam plate 3. A sliding plate 33 for brush 7 is provided with a follower 34 and a brush mounting plate 35. The follower 34 is engaged with the grooved cam 6. The brush 7 is attached to the brush mounting plate 35. In such a manner, since the position of the brush 7 is controlled in accordance with the grooved cam 6, timing flexibility is enhanced.

The rotation axis or output of the motor 30 is also extended toward the mounting plate 31 and an angle detection member 36 is attached to such axis. A first sensor 37 is mounted on bracket 12 adjacent member 36. A second sensor 38 is attached to a side of the bracket 12 at a position adjacent the sliding plate 14. A third sensor 39 is attached in the proximity of the pinion 32. A position detection hole 40 is formed in the grooved cam plate 3 in association with the third sensor 39. Each of sensors 37 to 39 is in the form of a proximity sensor.

Stoppers 42, 42 are formed on bracket 12 in order to stop the displacement of each linking mechanism when the first and second pressers 1, 2 are in the rest positions thereof. The stoppers 41, 42 prevent conditions such that the respective linking mechanisms cannot be displaced in reverse directions because they are driven beyond respective dead center points thereof. Furthermore, since a first rest position where the first presser 1 is waiting and a second rest position where the second presser 2 is waiting are at different locations as shown in FIGS. 4 to 6, interference between the two pressers does not occur, even if both the first and second pressers 1, 2 are in non-functioning conditions.

Figure 10:
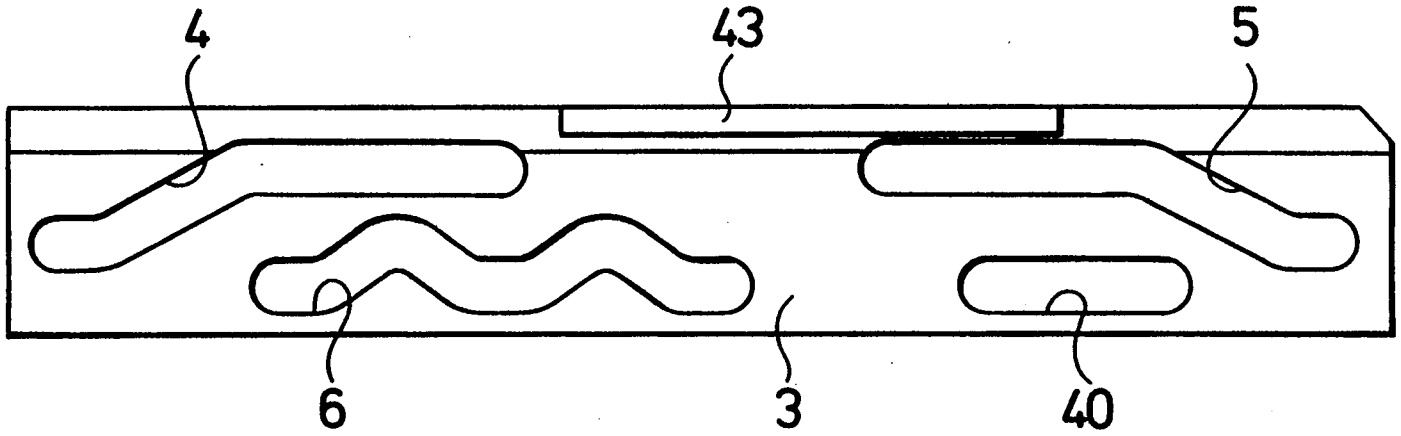
FIG. 10 is a plan view of a grooved cam plate shown in FIG. 1.
Figure 11:
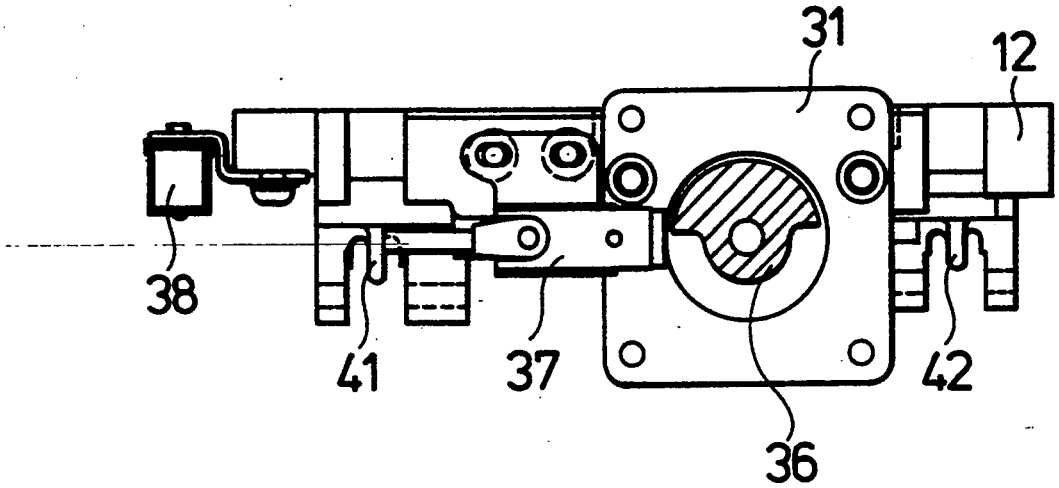
FIG. 11 is a plan view which illustrates a part of the embodiment shown in FIG. 1.
Figure 12:
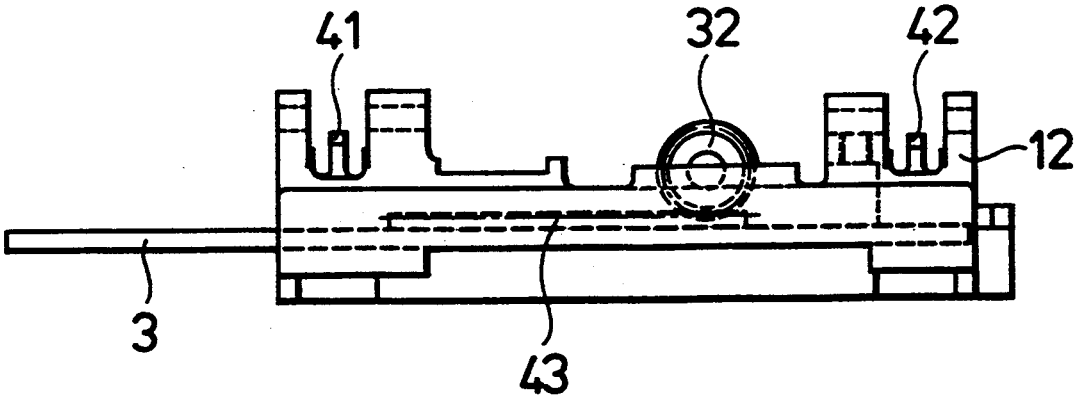
FIG. 12 is a bottom view which illustrates a part of the embodiment shown in FIG. 1.

FIG. 10 is a plan view of the grooved cam plate 3, FIG. 11 is a plan view which illustrates the structure in the area of the first and second sensors 37, 38, and FIG. 12 is a bottom view illustrating the grooved cam plate 3 being driven by the pinion 32. On the grooved cam plate 3 are formed the grooved cam 4 for driving in one direction, the grooved cam 5 for driving in the other direction, the grooved cam 6 for driving the brush, and the position detection hole 40. Each of the grooved cams 4, 5 has horizontal and inclined portions. When the followers 16, 17 are positioned on the respective horizontal portions, the corresponding pressers 1, 2 are in the rest positions thereof. On the other hand, when either of the followers 16, 17 is positioned at the top of the respective inclined portion, the corresponding presser 1, 2 is in the pressing position thereof. The grooved cam 6 for driving the brush is formed in the shape of the letter W and draws back the brush from the functioning position thereof for a period when each of the pressers 1, 2 is moved from the pressing position to the rest position thereof. A rack 43, which is engaged with the pinion 32, is formed on the upper portion of the grooved cam plate 3. An angle of rotation of the motor is detected by the first sensor 37 as a function of the angle of rotation of the angle detection member 36. The first sensor 37 is a proximity sensor which detects, e.g., the approach of a metal piece. The position of cam plate 3 is considered as an origin and first sensor 37 is set to be in an on-state when both the first and second pressers 1, 2 are in the rest positions thereof, as shown in FIGS. 4 to 6. The first sensor 37 is set to be in an off-state when the grooved cam 3 is shifted from the origin position toward the left, namely, toward the side shown in FIGS. 7 to 9, no matter how little such movement that may be. The second sensor 38 is also a proximity sensor and is in an on-state when the grooved cam plate 3 is positioned to the left of the origin. The third sensor 39 provided in relation to the position detection hole 40 is also a proximity sensor, and is in an on-state when the grooved cam plate 3 is positioned to the right of the origin as shown in FIGS. 1 to 3.

Figure 13:
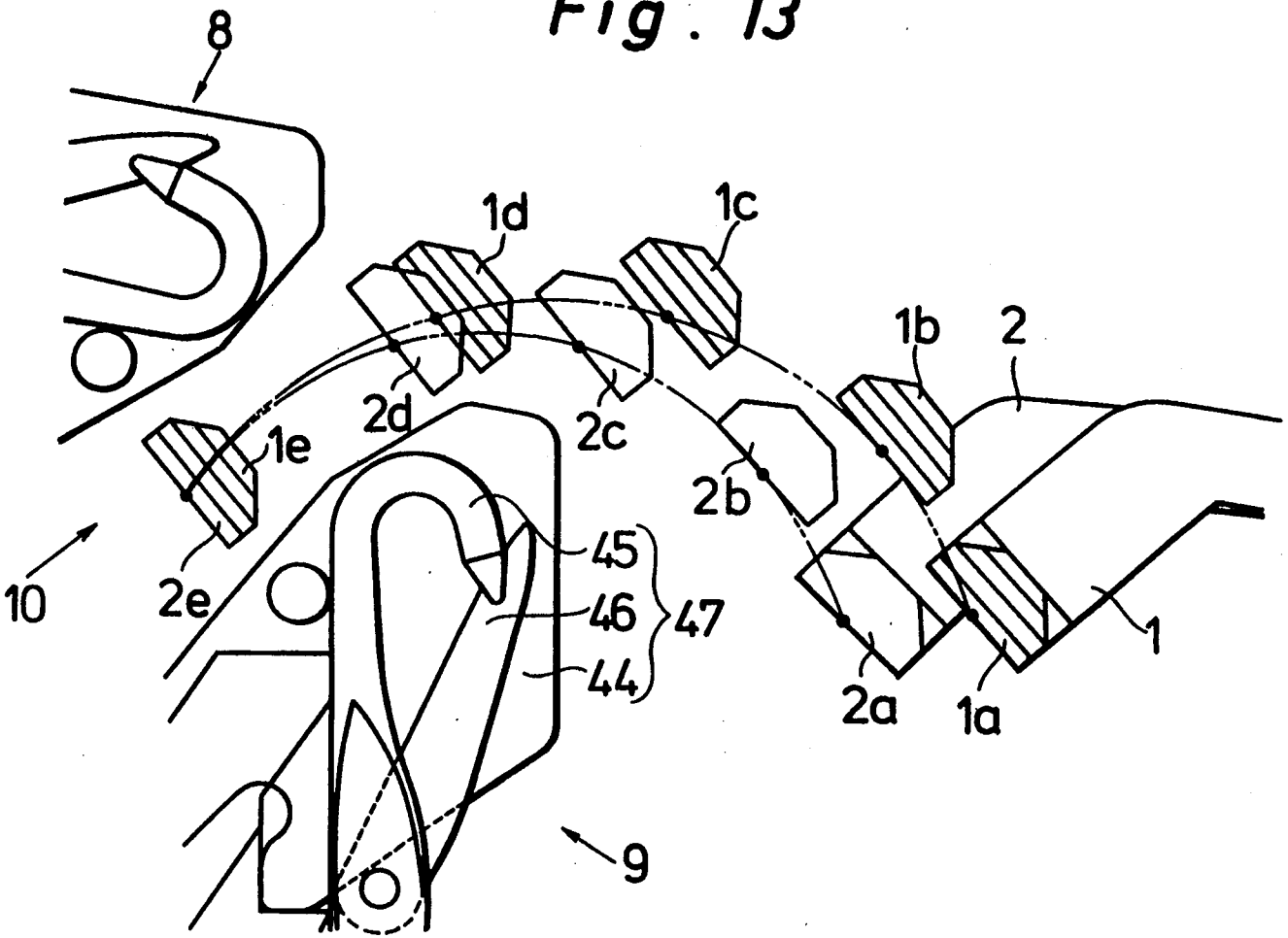
FIG. 13 is a schematic sectional view which illustrates traces of heads of pressers in the embodiment shown in FIG. 1.

FIG. 13 illustrates movement traces or paths of movement of the first and second pressers 1, 2. The traces or positions of the head of the first presser 1 are illustrated by 1*a*, 1*b*, 1*c*, 1*d* and 1*e*, and those of the second presser 2 are illustrated by 2*a*, 2*b*, 2*c*, 2*d* and 2*e*. While the positions 1*e*, 2*e* of the heads of the first and second pressers 1, 2 are identical on pressing stitches inside the gap 10, the rest positions 1*a*, 2*a* of the first and second pressers are different and spaced from each other. The traces or paths of movement of the heads of the pressers during movement thereof are set to prevent the pressers from interfering with each other during such movement. Such setting can be realized by changing the length of each arm constituting the first and second linking mechanisms or changing the position of the portion supported axially with the bracket 12. Furthermore, the movement traces are set to prevent the pressers from contacting with each sinker 44 of the needle beds 8, 9. In addition, brush 7 for opening a latch 46 of a latch needle 47 composed of a hook 45 and the latch 46 can be prevented from wearing due to contact with the pressers, because the brush is drawn back from the gap 10 upon movement of the pressers.

Figure 14:
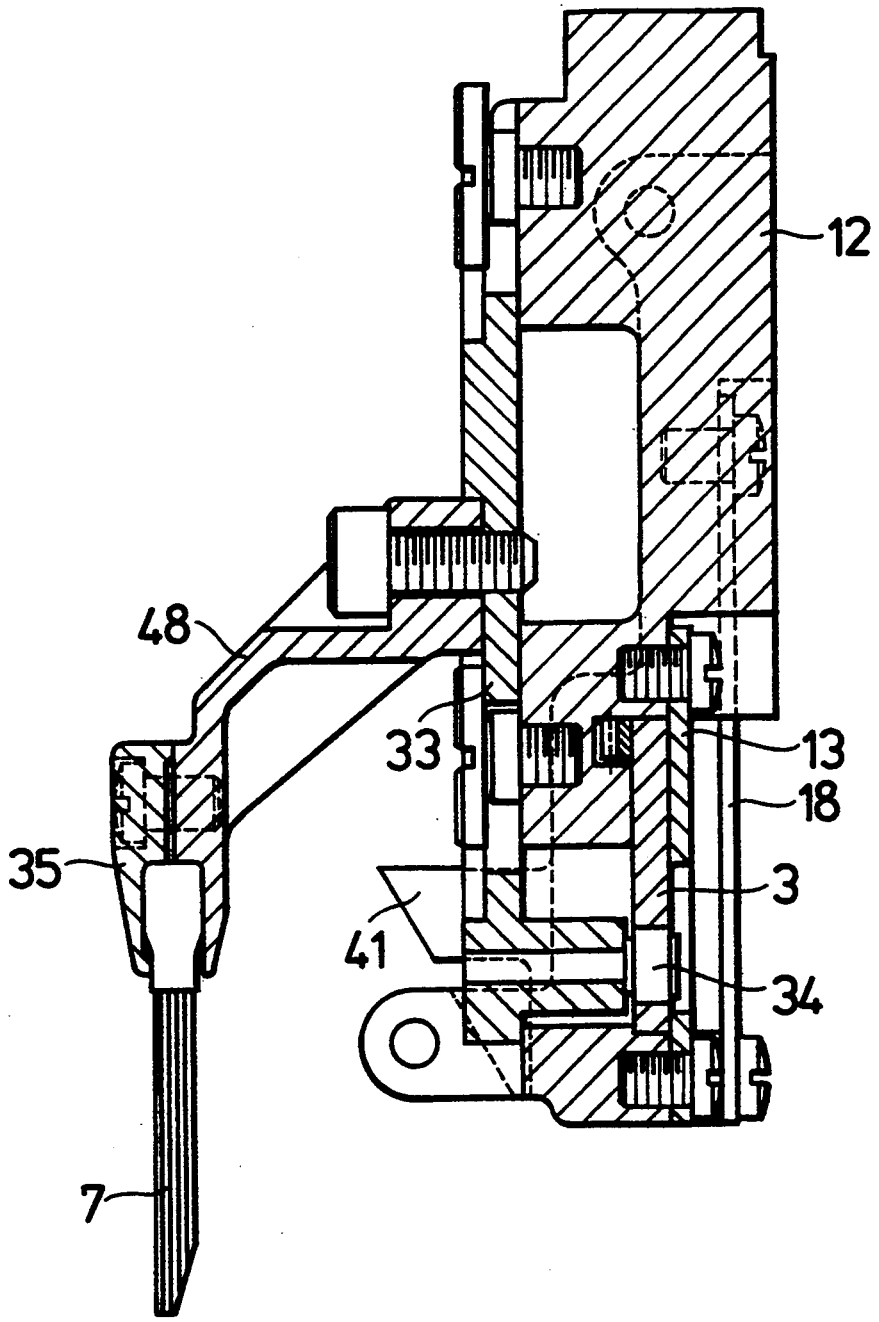
FIG. 14 is a sectional view taken along line XIV—XIV of FIG. 1.

FIG. 14 illustrates construction for preventing the brush 7 from wearing and is a sectional view taken along line XIV—XIV of FIG. 1. The follower 34 provided in the sliding plate 33 is displaced by sliding of the grooved cam plate 3, and the brush mounting plate 35 and the brush 7 thereby are moved via a brush mounting base 48.

FIGS. 15 to 19 illustrate construction and operation of another embodiment of the invention. Parts corresponding to parts shown in the embodiment of FIGS. 1 to 14 are identified by the same reference numerals. A slider 50, a first grooved cam plate 51 and a second grooved cam plate 52 are provided in place of the grooved cam plate 3.

Figure 15:
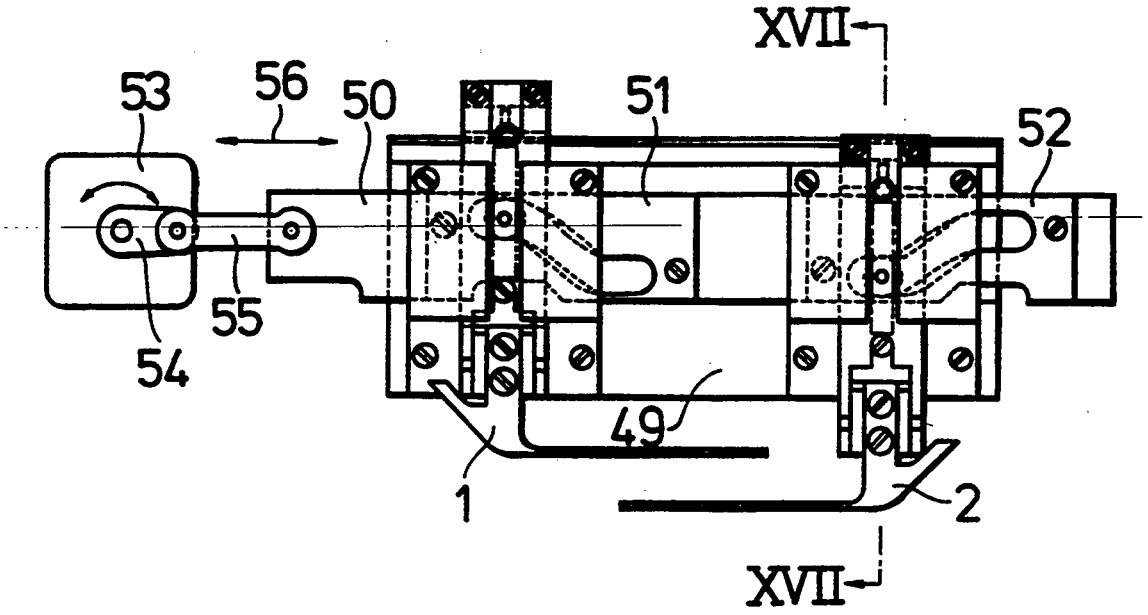
FIG. 15 is a schematic elevational view which illustrates a driving mechanism of another embodiment of the invention.
Figure 16:
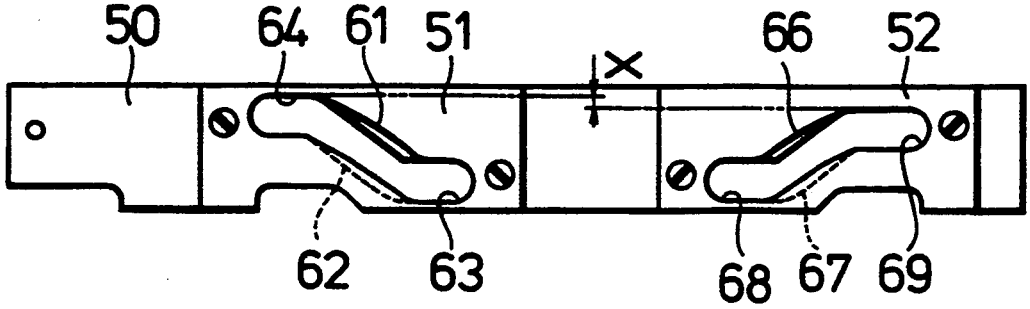
FIG. 16 is a plan view of a grooved cam of the embodiment shown in FIG. 15.

FIG. 15 illustrates a drive mechanism for reciprocally moving the slider 50 in longitudinal directions of needle beds. Rotational motion of a driving means in the form of a motor 53 is converted from a crank 54 through a connecting rod 55 to linear motion in opposite directions as indicated at 56. FIG. 16 illustrates upper and lower stages of grooved cams which are formed in the first and second grooved cam plates 51, 52 and in slider 50. An upper grooved cam 61 is formed in the first grooved cam plate 51. A lower grooved cam 62 is formed in the slider 50 beneath the upper grooved cam 61. The upper grooved cam 61 and the lower grooved cam 62 have identical and aligned end portions 63, 64 for achieving a pressing position and a rest position, but are not identical in inclined portions therebetween. In the second grooved cam plate 52 is formed an upper grooved cam 66, and a lower grooved cam 67 is correspondingly formed in the slider 50. The upper grooved cam 66 and the lower grooved cam have identical and aligned end portions 68, 69 for achieving a pressing position and rest portion, but are not identical in inclined portions therebetween. Additionally, an upper wall or side of end portion 64 for achieving the rest position in the first grooved cam plate 51 and an upper wall or side of end 69 for achieving the rest position in the second grooved cam plate 52 are at different levels that are offset by a distance X.

Figure 17:
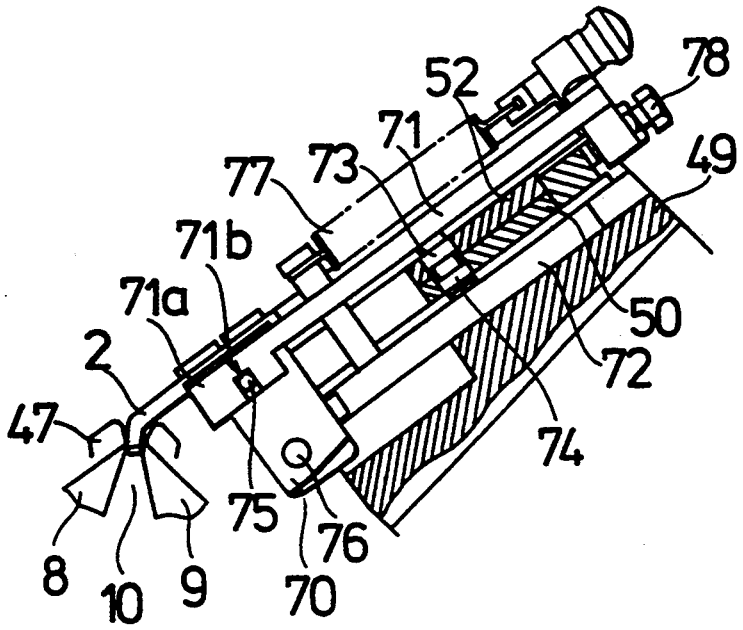
FIG. 17 is a sectional view taken along line XVII—XVII of FIG. 15.
Figure 18:
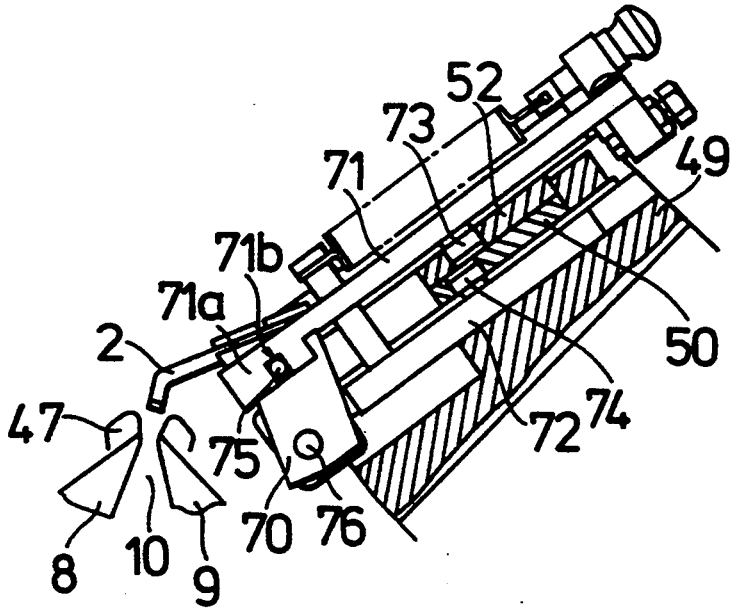
FIG. 18 is a sectional view which illustrates a state to which a second presser shifts from the state shown in FIG. 17.
Figure 19:
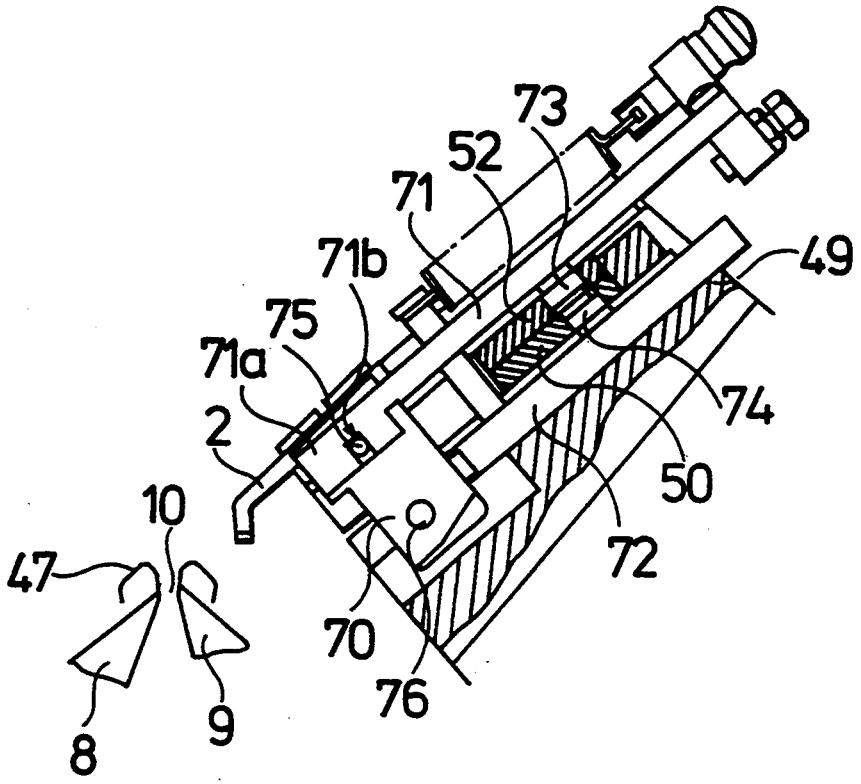
FIG. 19 is a sectional view which illustrates a state to which the second presser further shifts from the state shown in FIG. 18.
Figure 20:
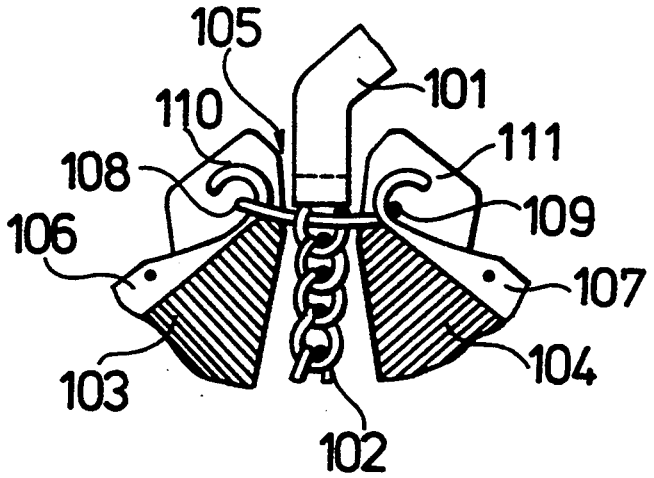
FIG. 20 is a schematic sectional view which illustrates an operating condition of a knitted fabric presser of a V-bed type flat knitting machine.

FIGS. 17 to 19 are sectional views taken along line XVII—XVII of FIG. 15. FIG. 17 illustrates the second presser 2 in the pressing position thereof, FIG. 18 illustrates the second presser 2 being moved from the gap 10, and FIG. 19 illustrates the second presser 2 in the rest position thereof. The second presser 2 is attached on a presser mounting base 70. The presser mounting base 70 together with an upper side sliding member 71 and a lower side sliding member 72 constitute a linking mechanism. The upper side sliding member 71 slides in conjunction with displacement of an upper side follower 73 engaged with the upper grooved cam 66 formed in the second grooved cam plate 52. The lower side sliding member 72 slides in conjunction with displacement of a lower side follower 74 engaged with the lower grooved cam 67 formed in the slider 50. A groove 71*b* is formed in an end portion 71*a* of the upper side sliding member 71, and a lower portion of the presser mounting base 70 is axially supported by a pin 76 provided on an end of the lower side sliding member 72. Pressing pressure of the second presser 2 is provided by a spring 77. The pressing power exerted by the spring 77 is adjusted by a bolt 78. The first presser 1 is driven similarly.

Since a difference between the upper grooved cam 66 and the lower grooved cam 67 is large in the inclined portions thereof, the second presser 2 is prevented from contacting the heads of the front and back needle beds, 8, 9 when the second presser 2 moves in the proximity of the gap 10, as shown in FIG. 18. In addition, as shown in FIG. 16, the respective rest positions of the first and second pressers 1, 2 are different even when both the pressers are in the respective rest positions, because there is a difference in levels between the end portion 64 defining the rest position of the first presser 1 and the end portion 69 defining the rest position side of the second presser 2, such level difference being indicated at X. Furthermore, movement traces or paths of movement of the first and second pressers 1, 2 also can be changed by changing a stop position defined by pin 76 on the presser mounting base 70 and the groove 71*b* formed in the end 71*a* of the upper side sliding member 71.

Needless to say, a grooved cam for moving the brush 7 can be provided in this embodiment to prevent the brush 7 from wearing, as in the embodiment of FIGS. 1 to 14. Furthermore, although the grooved cam 3 and the slider 50 are driven by the motors 30, 53, solenoidal, pneumatic or hydraulic means can be employed in place thereof.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. A knitted fabric presser unit to be mounted on a carriage of a flat knitting machine for pressing fabric knitted thereby in accordance with movement of the carriage in opposite longitudinal directions relative to spaced needle beds, said presser unit comprising:

a first presser to press knitted fabric upon movement of the carriage in one of the longitudinal directions, said first presser being mounted for movement between a first pressing position at a location to press knitted fabric and a first rest position spaced from said location;

a second presser to press knitted fabric upon movement of the carriage in the other of the longitudinal directions, said second presser being mounted for movement between a second pressing position at said location to press knitted fabric and a second rest position spaced from said location and from said first rest position;

a cam plate to be mounted for movement in reciprocal opposite first and second directions relative to the carriage, said cam plate having first and second driving cams;

a drive operatively connected to said cam plate to selectively move said cam plate in said opposite first and second directions;

a first back and forth movement assembly, including a first follower engaging said first driving cam and operatively connected to said first presser, to, when said cam plate is moved in said first direction, move said first presser from said first pressing position to said first rest position, and to, when said cam plate is moved in said second direction, move said first presser from said first rest position to said first pressing position;

a second back and forth movement assembly, including a second follower engaging said second driving cam and operatively connected to said second presser, to, when said cam plate is moved in said first direction, move said second presser from said second rest position to said second pressing position, and to, when said cam plate is moved in said second direction, move said second presser from said second pressing position to said second rest position; and said driving cams and said first and second back and forth movement assemblies being configured to prevent interference between said first and second pressers during movement thereof.

2. A presser unit as claimed in claim 1, wherein said cam plate comprises a grooved cam plate, said first and second driving cams comprise first and second cam grooves formed in said grooved cam plate, and said first and second followers fit into and guidingly move in said first and second cam grooves, respectively.

3. A presser unit as claimed in claim 1, further comprising a bracket to be mounted on the carriage, said cam plate being slidably mounted on said bracket, said first and second back and forth movement assemblies being mounted on said bracket, and said first and second pressers being supported by said first and second back and forth movement assemblies, respectively.

4. A presser unit as claimed in claim 1, further comprising a brush mounted for movement between a functioning position to open a latch of a latch needle of the knitting machine and a withdrawn position, said brush including a third follower, and said cam plate having a third driving cam engaged by said third follower and configured to, upon movement of said cam plate in said opposite first and second directions, move said brush from said functioning position to said withdrawn position when either of said first or second pressers is moved to said location.

5. A presser unit as claimed in claim 1, wherein each of said first and second back and forth movement assemblies comprises a member fixed to and movable with the respective said follower, and a linking mechanism connected to said member and supporting the respective said presser.

6. A presser unit as claimed in claim 5, wherein said member is movable in opposite directions transverse to said opposite first and second directions.

7. A presser unit as claimed in claim 1, wherein said cam plate comprises a slider, and first and second plate members mounted on said slider at respective longitudinally spaced positions thereof.

8. A presser unit as claimed in claim 7, wherein said first driving cam comprises a pair of facing cam grooves formed in said slider and said first plate member, and said second driving cam comprises a pair of facing cam grooves formed in said slider and said second plate member.

9. A presser unit as claimed in claim 8, wherein said pairs of facing cam grooves of each of said first and second driving cams have opposite end portions that are aligned and inclined portions that are offset.

10. A presser unit as claimed in claim 8, wherein said pair of facing cam grooves of said first driving cam has end surfaces that are offset in a direction transverse to said opposite first and second directions from end surfaces of said pair of facing cam grooves of said second driving cam.

11. A presser unit as claimed in claim 8, wherein each of said first and second back and forth movement assemblies comprises a pair of members fixed to and movable with respective followers engaged with respective cam grooves of the respective said pair of facing cam grooves, and a linking mechanism connected to said pair of members and supporting the respective said presser.

12. In an assembly of a carriage of a flat knitting machine, said carriage being movable in opposite longitudinal directions of a needle bed of the knitting machine, and a knitted fabric presser unit mounted on said carriage for pressing fabric knitted by the knitting machine in accordance with said movement of said carriage, the improvement wherein said presser unit comprises:

a first presser to press knitted fabric upon movement of said carriage in one of said longitudinal directions, said first presser being mounted for movement between a first pressing position at a location to press knitted fabric and a first rest position spaced from said location;

a second presser to press knitted fabric upon movement of said carriage in the other of said longitudinal directions, said second presser being mounted for movement between a second pressing position at said location to press knitted fabric and a second rest position spaced from said location and from said first rest position;

a cam plate mounted for movement in reciprocal opposite first and second directions relative to said carriage, said cam plate having first and second driving cams;

a drive operatively connected to said cam plate to selectively move said cam plate in said opposite first and second directions;

a first back and forth movement assembly, including a first follower engaging said first driving cam and operatively connected to said first presser, to, when said cam plate is moved in said first direction, move said first presser from said first pressing position to said first rest position, and to, when said cam plate is moved in said second direction, move said first presser from said first rest position to said first pressing position;

a second back and forth movement assembly, including a second follower engaging said second driving cam and operatively connected to said second presser, to, when said cam plate is moved in said first direction, move said second presser from said second rest position to said second pressing position, and to, when said cam plate is moved in said second direction, move said second presser from said second pressing position to said second rest position; and said driving cams and said first and second back and forth movement assemblies being configured to prevent interference between said first and second pressers during movement thereof.

13. The improvement claimed in claim 12, wherein said cam plate comprises a grooved cam plate, said first and second driving cams comprise first and second cam grooves formed in said grooved cam plate, and said first and second followers fit into and guidingly move in said first and second cam grooves, respectively.

14. The improvement claimed in claim 1, further comprising a bracket mounted on said carriage, said cam plate being slidably mounted on said bracket, said first and second back and forth movement assemblies being mounted on said bracket, and said first and second pressers being supported by said first and second back and forth movement assemblies, respectively.

15. The improvement claimed in claim 12, further comprising a brush mounted for movement between a functioning position to open a latch of a latch needle of the knitting machine and a withdrawn position, said brush including a third follower, and said cam plate having a third driving cam engaged by said third follower and configured to, upon movement of said cam plate in said opposite first and second directions, move said brush from said functioning position to said withdrawn position when either of said first or second pressers is moved to said location.

16. The improvement claimed in claim 12, wherein each of said first and second back and forth movement assemblies comprises a member fixed to and movable with the respective said follower, and a linking mechanism connected to said member and supporting the respective said presser.

17. The improvement claimed in claim 16, wherein said member is movable in opposite directions transverse to said opposite first and second directions.

18. The improvement claimed in claim 12, wherein said cam plate comprises a slider, and first and second plate members mounted on said slider at respective longitudinally spaced positions thereof.

19. The improvement claimed in claim 18, wherein said first driving cam comprises a pair of facing cam grooves formed in said slider and said first plate member, and said second driving cam comprises a pair of facing cam grooves formed in said slider and said second plate member.

20. The improvement claimed in claim 19, wherein said pairs of facing cam grooves of each of said first and second driving cams have opposite end portions that are aligned and inclined portions that are offset.

21. The improvement claimed in claim 19, wherein said pair of facing cam grooves of said first driving cam has end surfaces that are offset in a direction transverse to said opposite first and second directions from end surfaces of said pair of facing cam grooves of said second driving cam.

22. The improvement claimed in claim 19, wherein each of said first and second back and forth movement assemblies comprises a pair of members fixed to and movable with respective followers engaged with respective cam grooves of the respective said pair of facing cam grooves, and a linking mechanism connected to said pair of members and supporting the respective said presser.

23. The improvement claimed in claim 12, wherein the knitting machine is of the V-shaped bed type, and further comprising front and rear needle beds positioned with a gap therebetween, said gap defining said location, and said driving cams and said first and second back and forth movement assemblies being configured to prevent contact with sliders of said front and rear needle beds by said first and second pressers during movement thereof.

24. In a carriage movable in opposite longitudinal directions of needle beds of a flat knitting machine, the improvement of a knitted fabric presser unit installed as a single unit on said carriage for pressing fabric knitted by the knitting machine, said presser unit comprising:

a first presser for pressing knitted fabric upon movement of said carriage in one of said longitudinal directions;

a second presser for pressing knitted fabric upon movement of said carriage in the other of said longitudinal directions;

a first back and forth movement assembly for moving said first presser between a first pressing position at a gap between the needle beds and a first rest position spaced from said gap by a first distance;

a second back and forth movement assembly for moving said second presser between a second pressing position at said gap and a second rest position spaced from said gap by a second distance different from said first distance;

a drive assembly, operably connected to said first and second back and forth movement assemblies, to cause one of said first or second pressers to move to the respective said pressing position thereof and to cause the other of said first or second pressers to move to the respective said rest position thereof; and said first and second pressers being prevented from interfering with each other during movement thereof.

25. The improvement claimed in claim 24, wherein said drive assembly comprises a cam plate mounted for movement in reciprocal opposite first and second opposite directions relative to said carriage, said cam plate having first and second driving cams, and a drive operatively connected to said cam plate to selectively move said cam plate in said opposite first and second directions, said first back and forth movement assembly includes a first follower engaging said first driving cam and is operatively connected to said first presser to, when said cam plate is moved in said first direction, move said first presser from said first pressing position to said first rest position, and to, when said cam plate is moved in said second direction, move said first presser from said first rest position to said first pressing position, and said second back and forth movement assembly includes a second follower engaging said second driving cam and is operatively connected to said second presser to, when said cam plate is moved in said first direction, move said second presser from said second rest position to said second pressing position, and to, when said cam plate is moved in said second direction, move said second presser from said second pressing position to said second rest position.

26. The improvement claimed in claim 25, further comprising means for detecting the position of said cam plate relative to said carriage.

27. The improvement claimed in claim 25, wherein when said cam plate is in a predetermined reference position relative to said carriage, said first presser is in said first rest position and said second presser is in said second rest position.

28. The improvement claimed in claim 24, wherein said drive assembly is operable to selectively maintain both said first presser in said first rest position and said second presser in said second rest position.

* * * * *